United States Patent [19]

Baldwin et al.

[11] 4,135,649

[45] Jan. 23, 1979

[54] LIQUID DISPENSING TAP

[75] Inventors: Richard D. Baldwin, Dural; Stanley E. Edwards, Castle Hill, both of Australia

[73] Assignee: Lindeman (Holdings) Limited, Lidcombe, Australia

[21] Appl. No.: 799,336

[22] Filed: May 23, 1977

[30] Foreign Application Priority Data

May 28, 1976 [AU] Australia ..... PC6090

[51] Int. Cl.[2] ..... B67D 3/04

[52] U.S. Cl. ..... 222/511; 222/545

[58] Field of Search ..... 222/505, 511, 517, 528, 222/545

[56] References Cited

U.S. PATENT DOCUMENTS

| | | | |
|---|---|---|---|
| 1,715,452 | 6/1929 | Endicott | 222/545 X |
| 3,400,866 | 9/1968 | Fattori | 222/511 |
| 3,595,445 | 7/1971 | Buford et al. | 222/511 X |
| 3,972,452 | 8/1976 | Welsh | 222/505 X |

FOREIGN PATENT DOCUMENTS

| | | | |
|---|---|---|---|
| 552227 | 11/1956 | Italy | 222/511 |

*Primary Examiner*—Stanley H. Tollberg
*Assistant Examiner*—Charles A. Marmor
*Attorney, Agent, or Firm*—Schwartz & Weinrieb

[57] ABSTRACT

A tap, adapted to be fitted to a filling tube of a liquid container such as a bag formed of plastic material, and which has a diaphragm to sealingly close the spout of the tap, is disclosed. The diaphragm is elastically deformable so as to break the seal and allow liquid to pass through the tap. The tap is further provided with a sealing surface which the diaphragm engages so as to close the spout, and a sleeve portion, extending from the sealing surface, dimensioned so as to be press fitted into and sealingly engaged with the tube.

7 Claims, 2 Drawing Figures

LIQUID DISPENSING TAP

FIELD OF THE INVENTION

The present invention relates to liquid dispensing taps, and more particularly to liquid dispensing taps employing a diaphragm to sealingly close the spout of the tap and which is deformable to break the seal.

BACKGROUND OF THE INVENTION

The abovementioned diaphragm taps are particularly employed with bags fabricated of plastic material, such often being bags used to distribute wine. Due to the low surface tension of wine, even small defects in the sealing surface of the spout can result in leakage. Although there is the loss of the wine per se to be considered, an important additional consideration is the damage done to the carton containing the defective tap as well as the stored cartons surrounding it. Thus, considerable loss results from just one defective tap.

A further problem of diaphragm taps is that they cannot easily be pressure tested, so as to detect faults in the moulding of the tap, prior to engagement with the bag.

Still a further problem is that known diaphragm type taps that employ a filling tube use the free end of the tube to sealingly engage the diaphragm so as to prevent liquid from leaking through the tap. Although this is an economical and practical arrangement, since the container is filled by the engagement of a dispensing nozzle with the free end of the filling tube, there is the disadvantage that in practice, if the dispensing nozzle is not properly aligned with the fitting tube at all times, then some damage to the free end of the fitting tube will result. Thus, a further source of possible leaks is the deformation of the free end of the filling tube.

SUMMARY OF THE INVENTION

It is the object of the present invention to ameliorate the above disadvantages of known taps.

In general form, the present invention comprises a tap adapted to be fitted to a filling tube of a liquid container and which has a diaphragm to sealingly close the spout of the tap, the diaphragm being elastically deformable so as to break the seal and allow liquid to pass through the tap. A sealing surface is engaged by the diaphragm so as to close the spout, and a sleeve portion, extending from the sealing surface, is dimensioned so as to be press fitted into and sealingly engaged with the tube.

BRIEF DESCRIPTION OF THE DRAWINGS

A preferred form of the invention will now be described by way of example with reference to the accompanying drawings wherein.

DETAILED DESCRIPTION OF THE ILLUSTRATED EMBODIMENTS

Figure 1:
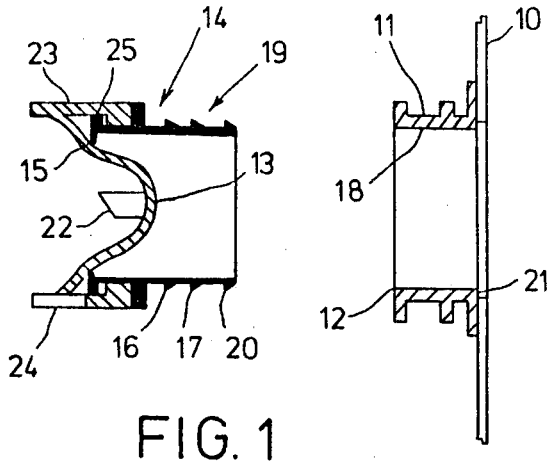
FIG. 1 is a sectioned side elevation view of a tap, embodying the present invention, adapted to be attached to a bag fabricated of a plastic material.

In FIG. 1, bag portion 10 is provided with a tube 11 through which the bag is filled with liquid. In the process of filling, and more particularly when the bag is employed to distribute wine, a nozzle enters the tube 11 and sealingly engages the edge 12 in order to draw air from within the bag, whereby the wine is then subsequently forced into the bag. In the past, the contact of the abovementioned nozzle with edge 12 has resulted in some damage to the edge 12 giving rise to problems in that the prior taps required the edge 12 to sealingly engage the diaphragm 13. Thus, if the edge 12 was even slightly damaged, leakage would occur. To avoid the use of edge 12 as a sealing surface of the tap, a sleeve 14 is provided as an intermediate member between the diaphragm 13 and the tube 11.

The sleeve 14 is provided with a sealing edge 15 for engaging the diaphragm 13, and with circumferentially extending ridges 16 and 17 for sealingly engaging the inner surface 18 of the tube 11 when the portion 19 of the sleeve is inserted therein. Ridge 20 is provided to for engaging edge 21 of the tube 11 so as to prevent withdrawal of the tap when portion 19 is fully inserted into tube 11.

The diaphragm 13 is formed with a projection 22 to be manipulated by means of a finger of the user of the tap so as to elastically deform the diaphragm 13 and break the seal. The diaphragm supporting member 23 is provided with a spout 24 through which the liquid passes when the diaphragm is deformed.

The supporting member 23 and diaphragm 13 are integrally formed of a plastic material so as to enable the member 23 to be pushed over the ridge 25 and sealingly engage the sleeve 14.

Figure 2:
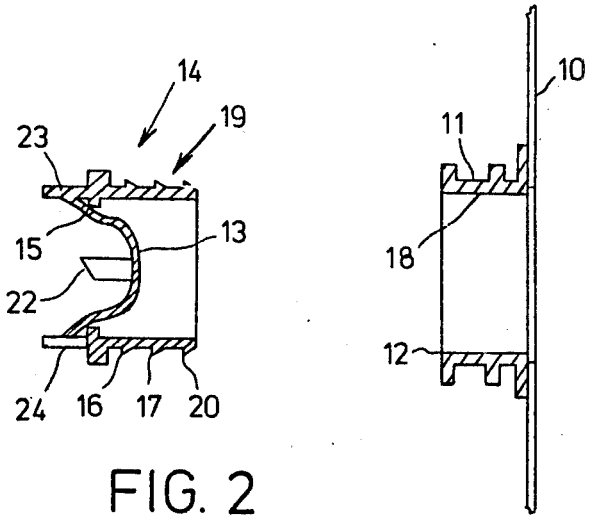
FIG. 2 is a sectioned side elevation view depicting a variation of the tap of FIG. 1.

In the embodiment of FIG. 2, the diaphragm 13, member 23 and sleeve 14 are integrally formed, however the reference characters of the tap of FIG. 2 have been designated with the numerals of corresponding reference characters of the embodiment of FIG. 1.

It should be noted that in both of the above embodiments, the sealing edge 15 is not an integral part of the tube 11, thus enabling pressure testing of the tap, so as to detect defects in its moulding, prior to the fitting of the tap to the bag.

Obviously, many modifications and variations of the present invention are possible in light of the above teachings. It is therefore to be understood that within the scope of the appended claims, the present invention may be practiced otherwise than as specifically described herein.

What we claim is:

1. A tap adapted to be fitted to a filling tube of a liquid container, comprising:

means defining a spout within said tap;

elastically deformable diaphragm means operatively connected to said spout means and movable substantially within a transverse, radial plane for controlling the issuance of said liquid from said container through said spout means; and sleeve means interposed between said diaphragm means and said filling tube, one end of said sleeve means being sealingly disposed internally of said filling tube, and the other end of said sleeve means defining a sealing surface disposed internally of said diaphragm means for sealingly engaging said diaphragm means so as to prevent the issuance of said liquid from said container through said spout means.

2. A tap according to claim 1 wherein said sleeve means has at least one radially outwardly projecting circumferential ridge which engages the internal surface of said filling tube.

3. A tap according to claim 2 wherein said diaphragm means, sealing surface and sleeve means are integrally formed.

4. A tap according to claim 1 wherein said tap comprises two portions, a first portion comprising a cylindrical body substantially closed at one end by said diaphragm means, and a second portion comprising said sleeve means and sealing surface, a portion of said sleeve means being sealingly locatable within said cylindrical body so as to locate said sealing surface adjacent said diaphragm means.

5. A tap as set forth in claim 4, wherein:

said diaphragm means is disposed internally of said cylindrical body so as to define a substantially annular cavity with said cylindrical body; and said sealing surface of sleeve means is interposed between said diaphragm means and said cylindrical body within said cavity.

6. A tap according to claim 1 wherein said sealing surface is part of a radially inwardly projecting lip formed integral with said sleeve means.

7. A tap as set forth in claim 1, wherein:

said diaphragm means, said sealing surface, and said sleeve means are integrally formed.

* * * * *